US006634271B1

(12) United States Patent
Dal Ceredo

(10) Patent No.: US 6,634,271 B1
(45) Date of Patent: Oct. 21, 2003

(54) MACHINE FOR MARKING SKINS OR OTHER ARTICLES IN SHEET FORM BY PERFORATION

(75) Inventor: Giuliano Dal Ceredo, Montecchio Maggiore (IT)

(73) Assignee: Ger Elettronica SRL, Montecchio Maggiore (IT)

( * ) Notice: Subject to any disclaimer, the term of this patent is extended or adjusted under 35 U.S.C. 154(b) by 0 days.

(21) Appl. No.: 09/926,398

(22) PCT Filed: Apr. 28, 2000

(86) PCT No.: PCT/EP00/03888

§ 371 (c)(1),
(2), (4) Date: Oct. 26, 2001

(87) PCT Pub. No.: WO00/67966

PCT Pub. Date: Nov. 16, 2000

(30) Foreign Application Priority Data

May 5, 1999 (IT) ..... VE99A0017

(51) Int. Cl.[7] ..... B26D 5/08; B26F 1/14

(52) U.S. Cl. ..... 83/620; 83/550; 83/553; 83/660; 83/687

(58) Field of Search ..... 83/550, 549, 553, 83/620, 639, 660, 687, 691; 234/94–119

(56) References Cited

U.S. PATENT DOCUMENTS

| | | | | |
|---|---|---|---|---|
| 749,164 A | * | 1/1904 | Burke | 234/99 |
| 2,576,328 A | | 11/1951 | Allison | |
| 2,911,045 A | | 11/1959 | Wright | |
| 3,015,884 A | | 1/1962 | Chamberlain | |
| 3,477,317 A | * | 11/1969 | Liander | 76/107.1 |
| 3,709,082 A | * | 1/1973 | Leska | 83/618 |
| 3,780,939 A | * | 12/1973 | Woodie | 234/115 |
| 3,818,789 A | | 6/1974 | Vargo | |
| 4,025,040 A | * | 5/1977 | O'Neal | 234/1 |
| 4,509,396 A | | 4/1985 | Schall et al. | |
| 4,596,359 A | | 6/1986 | Nordli | |
| 4,823,661 A | | 4/1989 | Freres | |
| 4,898,056 A | * | 2/1990 | Grobb et al. | 83/689 |

FOREIGN PATENT DOCUMENTS

| | | |
|---|---|---|
| DE | 38 17 824 A | 11/1989 |
| DE | 94 19 403 U | 2/1995 |
| EP | 0 508 557 A2 | 10/1992 |
| EP | 0 763 408 A | 3/1997 |
| FR | 2 311 635 | 12/1976 |
| FR | 2 527 500 | 12/1983 |
| GB | 859 526 A | 10/1959 |
| GB | 928428 | 9/1961 |
| GB | 1 222 961 | 2/1971 |

* cited by examiner

*Primary Examiner*—Allan N. Shoap
*Assistant Examiner*—Isaac N Hamilton
(74) *Attorney, Agent, or Firm*—Hoffman, Wasson & Gitler

(57) ABSTRACT

A machine for marking skins or other articles in sheet form by perforation, comprising:

a support structure for m rows each formed from n vertical punches, m and n being whole numbers with m≧1 and n≧2, the upper ends of the punches being inserted into holes of a corresponding plate elastically supported on the support structure, each lower end of the vertical punches of each row interacting with a corresponding wedge element of a plurality of n.m wedge elements, each wedge element being operable by an axial movement of a corresponding operating bar to position the punches between two end positions in which the punches remain fixed, in one of which a cutting edge of the punches is substantially at the level of an upper surface of the plate and in the other of which said cutting edge of the punches lies inside the hole, the distance between the two end positions of the cutting edge corresponding with the thickness of said operating bars for the wedges, mechanism to move the bars;

a counterplate facing the plate and movable vertically towards and away from the plate to cause this latter to descend together with a skin retained between them towards the punches and obtain perforation by only those punches which have their cutting edge at the level of the upper surface of the plate and which have been positioned in an arrangement corresponding to an alphanumeric character in accordance with a predetermined code.

13 Claims, 4 Drawing Sheets

FIG. 4
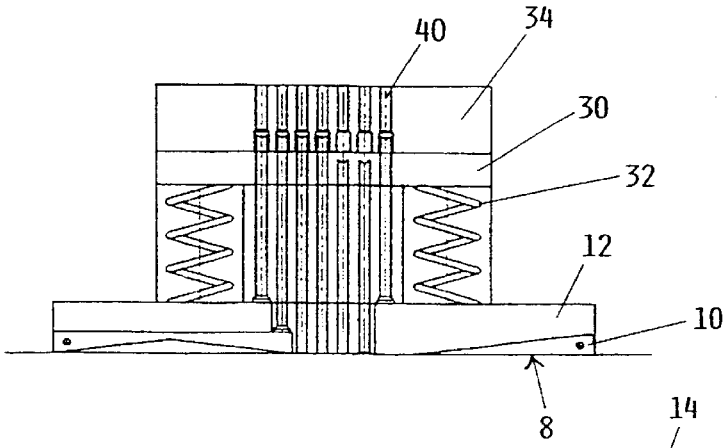
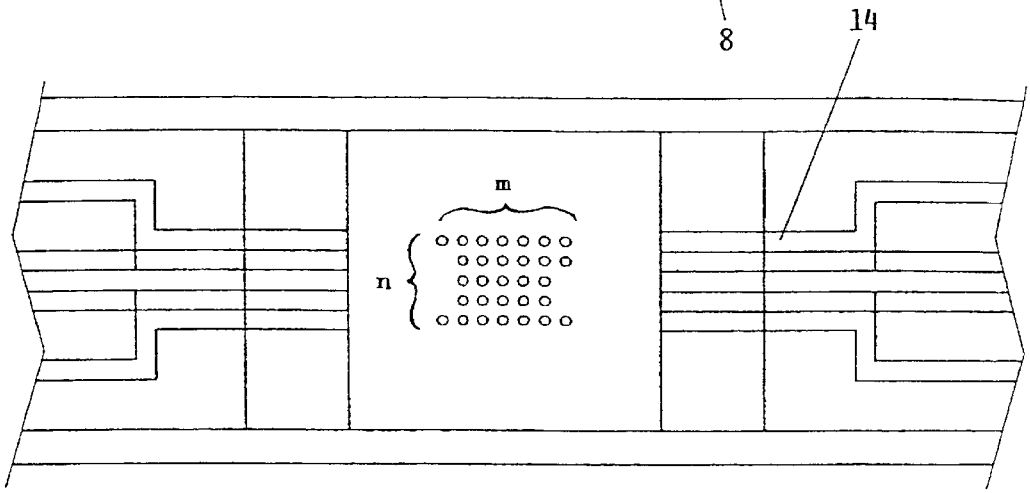
FIG. 5
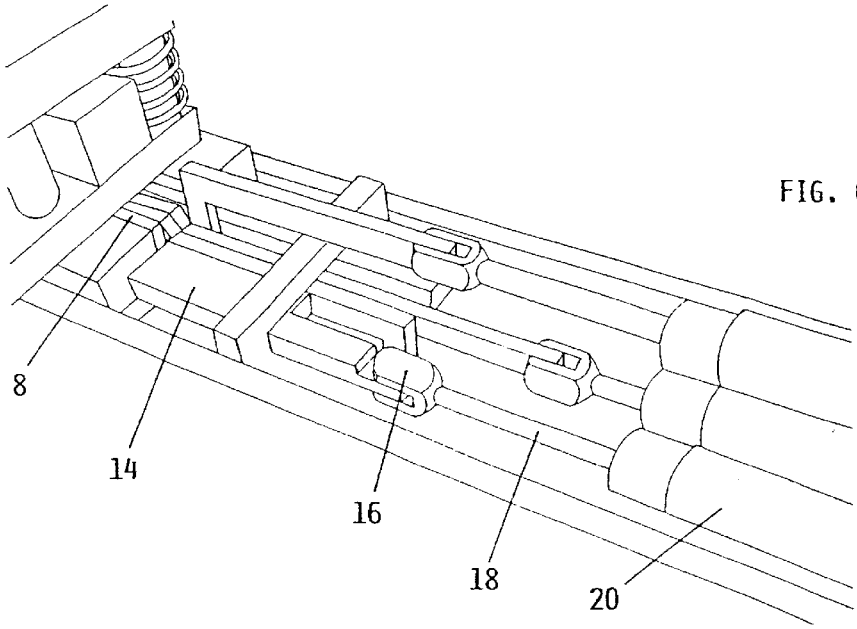
FIG. 6

MACHINE FOR MARKING SKINS OR OTHER ARTICLES IN SHEET FORM BY PERFORATION

FIELD OF THE INVENTION

This invention relates to a machine for marking skins or other articles in sheet form by perforation.

Unprocessed or semi-processed skins and generally other articles in sheet form are subjected to marking. in order to impress information regarding the supplier, the production batch, the selection, the thickness, the surface, etc.

DESCRIPTION OF THE PRIOR ART

To implement this marking, a marking process is known using punches, the end of which forms incisions reproducing arabic numerals in the skin.

A process is also known for marking skins and other objects in sheet form by perforation, in which one or more holes are made in a certain area of the object in positions which enable an optical reader to automatically read the stamped code in the same manner as a bar code. In this specific case the holes are grouped in rows, each row of five holes representing a character. Auxiliary holes are also present, positioned at the corners of the rectangle containing the code, to provide a reference for automatic code reading by the reading device.

To implement the process it is known to use a device comprising within a seat in a base support a plurality of bars each provided with cylindrical punches having a conical end and a central hole for discharging the material. Said punches are applied to each bar in a number and arrangement corresponding to one alphanumeric character in the predetermined code.

This known device, which has the advantage of instantaneous marking, presents on the other hand certain drawbacks, and in particular:

laborious bar substitution when changing the number to be coded, poor skin consistency around the hole because of stretching due to the conical profile of the punch.

Marking devices are also known with a punch movable along a line or in two perpendicular directions under the control of a computer.

These devices, which enable the coded number to be easily changed by simply operating the computer keyboard, have the drawback of being slow in operation because the holes have to be made one at a time.

DE-U-9419403 relates to an arrangement for forming strip-shaped material with at least one adjustable tool carrying module which can be actuated by means of a drive. Two modules are provided, each carrying at least two independently usable tools and/or at least one processing unit, which modules can be adjusted in the longitudinal and/or transverse direction relative to the feed direction of the material to be processed.

An object of the invention is to provide a machine for marking skins by perforation in which the coded number to be marked can be quickly and easily changed, and which is very fast in operation.

BRIEF SUMMARY OF THE INVENTION

This object and further ones are attained according to the invention through a machine for marking skins or other articles in sheet form by perforation, by comprising:

a support structure for m rows each formed from n vertical punches, m and n being whole numbers with m≧ and n≧2, the upper ends of said punches being inserted into holes of a corresponding plate elastically supported on said support structure, each lower end of said vertical punches of each row interacting with a corresponding wedge element of a plurality of n.m. wedge elements, each wedge element being operable by an axial movement of a corresponding operating bar to position said punches between two end positions in which the punches remain fixed, in one of which a cutting edge of punches is substantially at the level of an upper surface of said plate and in the other of which said cutting edge of the punches lies inside said hole, the distance between the two end positions of said cutting edge corresponding with the thickness of said operating bars for said wedges, moving means for said bars, a counterplate facing said plate and movable vertically towards and away from said plate to cause this latter to descend together with a skin retained between them towards said punches and obtain perforation by only those punches which have their cutting edge at the level of the upper surface of the plate and which have been positioned in an arrangement corresponding to an alphanumeric character in accordance with a predetermined code.

BRIEF DESCRIPTION OF THE DRAWINGS

This object and further ones are attained according to the invention through a machine as described in claim 1.

A preferred embodiment of the invention is described in detail hereinafter with reference to the accompanying drawings, on which:

FIG. 4 shows the head with the counterplate in the lowered position, FIG. 5 shows the head from above, FIG. 6 is a perspective view of the punch operating device.

DESCRIPTION OF PREFERRED EMBODIMENT

Figure 2:
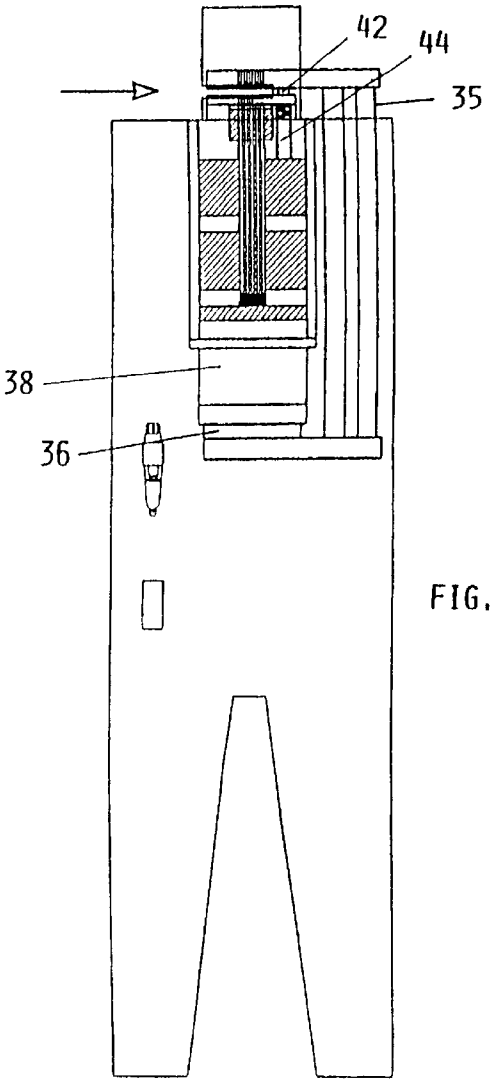
FIG. 2 is a side view thereof.
Figure 1:
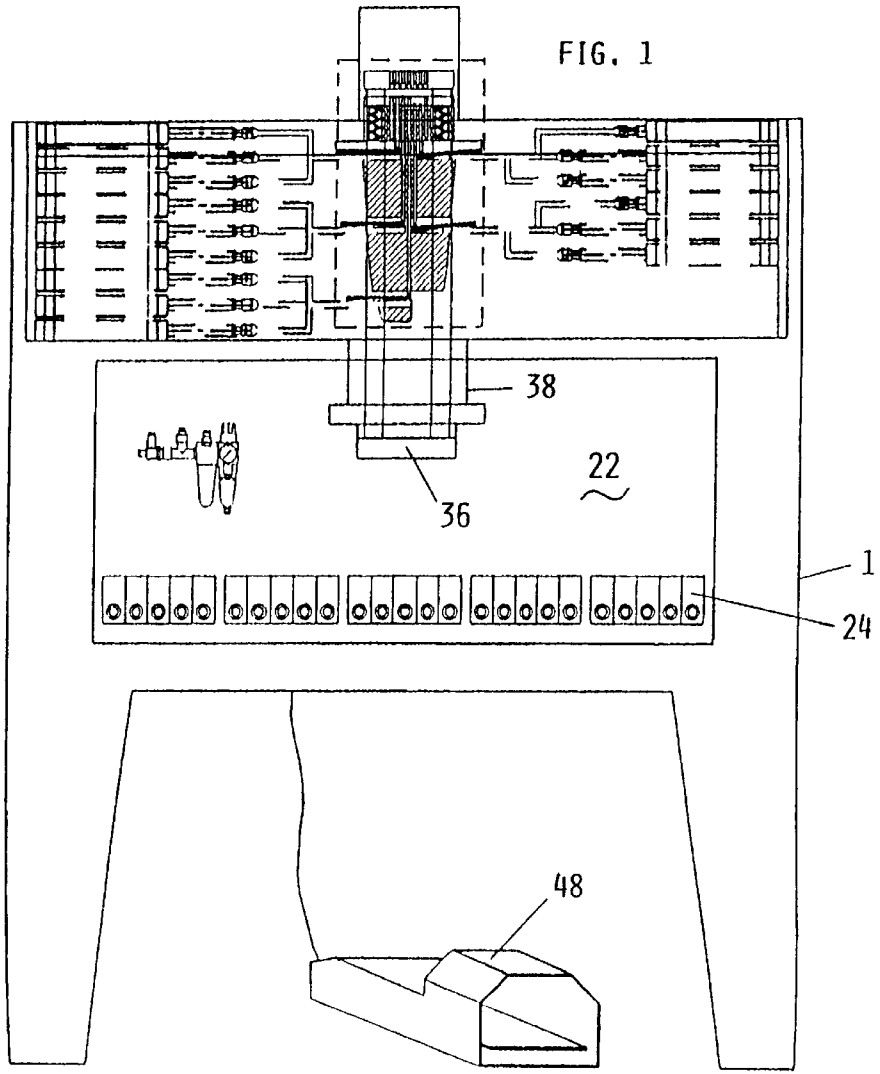
FIG. 1 is a schematic front view of a marking machine according to the invention.
Figure 3:
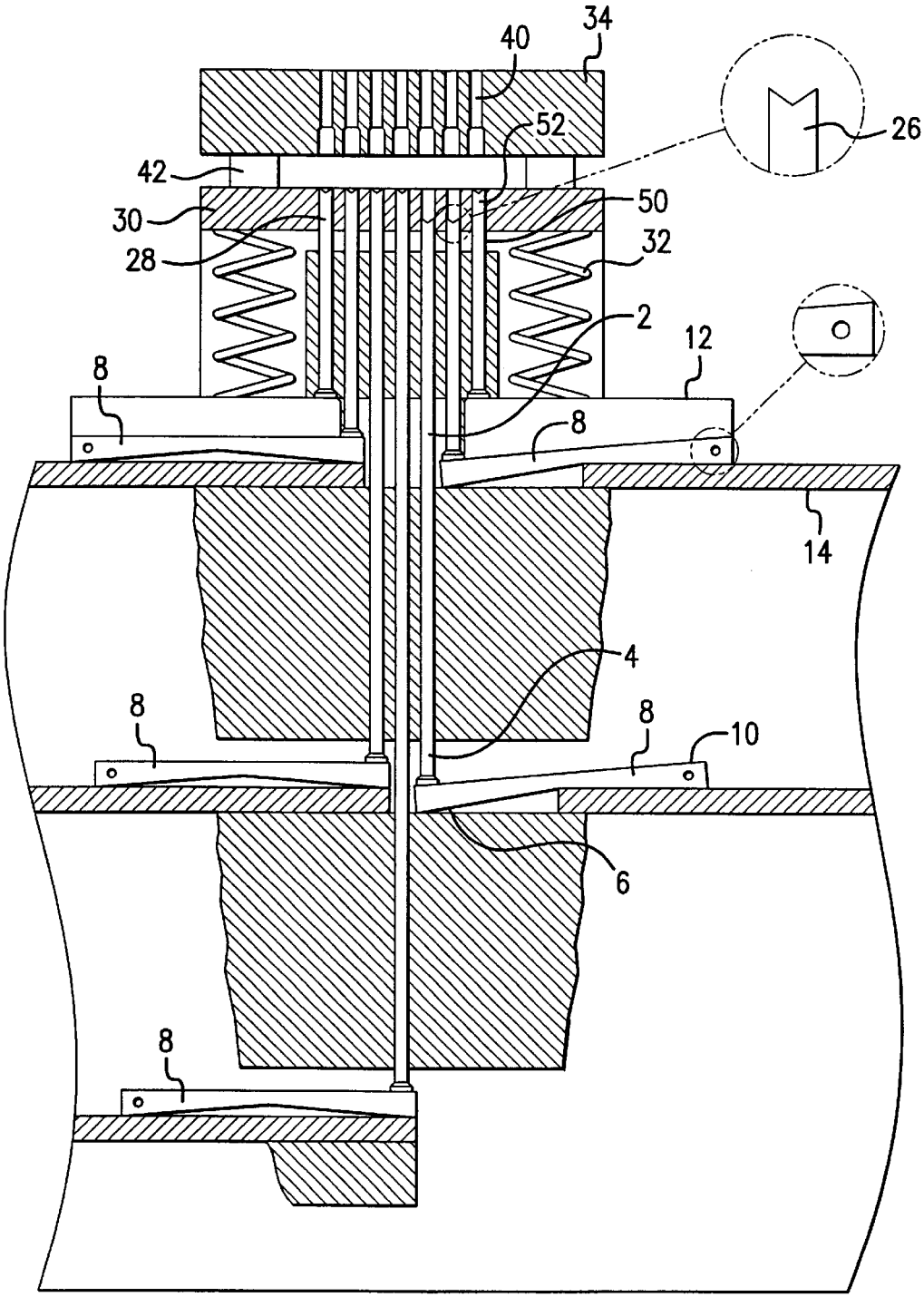
FIG. 3 is an enlarged view of the detail enclosed by the dashed line of FIG. 1.

As can be seen from the figures, the marking machine of the invention comprises substantially a metal structure 1 with a perforation stamper the stamping head of which consists of m=five rows each formed from n=five punches 2 plus two further outer rows for the reference holes bounding the area within which the code is impressed. Each punch 2 consists of a cylindrical body provided at its upper end with a cutting part 26.

The five punches 2 of each row are aligned along an axis longitudinal to the skin direction and have their lower end 4 in contact with one end 6 of a wedge 8 having its other end 10 hinged to a frame 12.

The wedges 8 are coplanar and can be raised at their free end under the control of corresponding axially movable bars 14 connected by articulated joints 16 to the pistons 18 of corresponding pneumatic cylinders 20.

Said bars are shaped such that those ends which act on the wedges lie in a single plane and are mutually adjacent.

The punches of each row are of equal length, this length however being different from that of the punches of the other rows so that the actuators, the bars and the wedges lie in superposed planes. Each piston 18 can move between a retracted position in which the wedge is slightly inclined downwards at its free end, and an extended position in which the wedge is virtually horizontal.

Said pneumatic cylinders are connected to a single air receiver 22 and are provided with solenoid shut-off valves 24 controlled by an electronic system (not shown on the drawings). The upper ends 26 of the punches 2 of each row m are housed in through holes 28 provided in a steel plate 30 supported by pairs of guide rollers and by springs 32 resting on the frame 12.

The punches can be positioned axially between an upper position in which their cutting end is substantially at the level of the upper surface of the plate 30 and a lower position in which the cutting end of the punch lies inside the hole 28. The distance between the two end positions of the cutting ends corresponds to the thickness of the wedge raising bar.

Facing the plate 30 there is a steel counterplate 34 rigidly connected by rods 35 to the piston 36 of a cylinder 38 of vertical axis. Said plate comprises a plurality of holes 40 in a number equal to the number of punches and having their axis aligned with the axis of the punches.

Said plate 34 also comprises two collimation cylinders 42 cooperating with corresponding holes 44 provided in the plate 30. The plate 30 also comprises holes 50 housing reference punches 52 which rest on the structure 12 and have their cutting ends substantially coplanar with the upper surface of the plate 30.

The marking machine of the invention is used by firstly preparing the marking head defined by the n punches of the m rows on the basis of the predetermined composition of the predetermined code corresponding to the alphanumeric character with which the skin is to be marked.

This preparation is done by operating the solenoid valves 24 to feed predetermined cylinders 20 such that their pistons 18, on extending axially, cause the wedges 8 to assume a horizontal configuration which sets the punches in a position slightly raised from those punches resting on the wedges for which the corresponding piston has not been made to extend.

When the various punches have been positioned, the skin is inserted to position it over the plate 30. Using the pedal unit 48, the operator then causes the piston 36 to emerge from the cylinder 38 so as to lower the counterplate 34 by way of the rods 35. This lowering operation is facilitated by the engagement of the collimation cylinders 42 in the reference holes 44.

When the skin has been positioned correctly, further emergence of the piston causes, in succession:

the counter plate 34 to press on the surface of the skin, which is hence retained between the two plates 30, 34;

the two plates 30, 34 to move downwards, with the skin retained between them, through a distance such that only the more raised punches perforate the skin and engage in the holes 28 in the plate 34. During this stage the punches 52 also form in the skin the reference holes for automatic reading by the optical sensing system.

The piston 36 is then made to retract into the cylinder 38, the elastic reaction of the springs 32 causing the plate 30 to return to its original configuration.

The skin is then extracted and the machine is ready for inserting and marking the next skin. If this new marking is to have the previously used code, the cylinders maintain the bars in the previous configurations, whereas if the code is to be changed the solenoid valves 24 are operated simultaneously to vary the position of the bars 14 relative to the wedges 8 and hence the position of the punch ends within the plate 30.

From the aforegoing it is apparent that the marking machine of the invention presents numerous advantages, and in particular:

it enables all punches to be positioned simultaneously by simply operating the solenoid valves, it enables all the holes cooperating in forming the code to be marked simultaneously, the wedge positioning system makes it possible to electrically position the punches in positions stable towards the high mechanical stresses involved in marking, it enables actuator means of any type to be used, it enables close-together holes to be made under the control of actuators which can be of large dimensions because of the profile of the positioning bars and their small distance apart at the end at which they act on the wedges, it allows increase in the number m of rows and hence of alphanumeric characters to be printed (code size) because of the facility for adding actuators in superposed planes, the perforated region is less impaired after the operation in that the use of a cylindrical punch results in a hole of stable dimensions with the material around the hole not being weakened by stretching due to the conicity of traditional punches, it can be positioned in line in production processes because of the high piston positioning speed (a fraction of a second) and the duration of the stamping cycle (about 1 second); in particular each individual skin can be marked with a progressive code.

In a variant (not shown on the drawings) traditional punches with conical ends and an internal channel for discharging the downward-cut scrap are used. In this configuration the counterplate is made of a material, preferably nylon, which does not damage the punch cutting profile.

Figure 7:
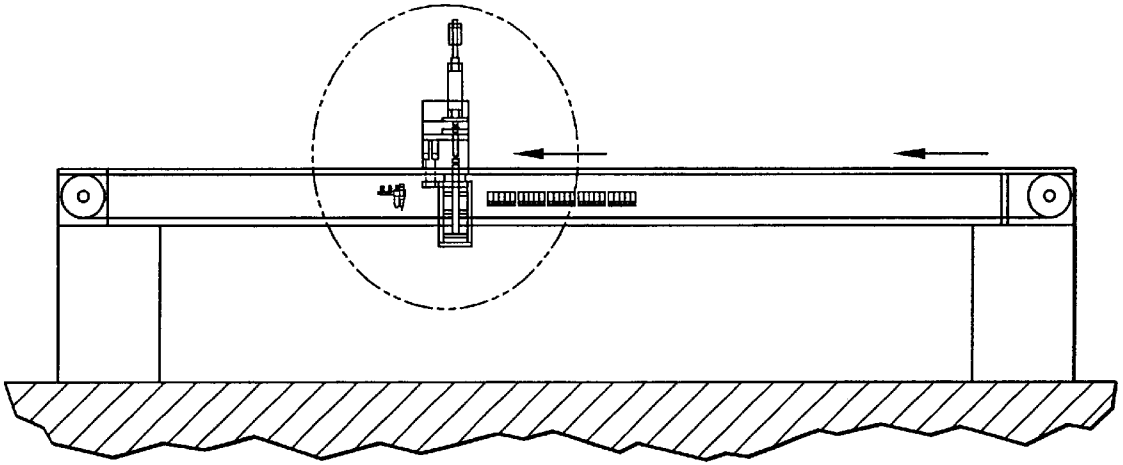
FIG. 7 shows the machine applied to a conveyor belt.
Figure 8:
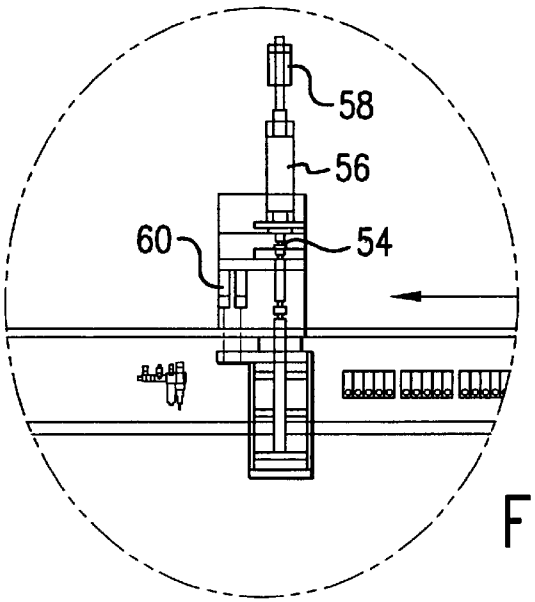
FIG. 8 is an enlarged detail of FIG. 7.

FIGS. 7 and 8 show the application of the marking machine to a conveyor belt for skin feeding.

In this embodiment the counterplate 34 is connected to the piston 54 of a cylinder 56 mounted on a bridge 58 straddling the belt 58. In addition the collimator cylinders 60 between the two plates emerge completely from the lower plate to enable the skin to pass.

I claim:

1. A machine for marking skins or other articles in sheet form by perforation, comprising:

a) a support structure for m rows, each row formed from n vertical punches, m and n being whole numbers with $m \geqq 1$ and $n \geqq 2$, b) a plate resiliently supported on said support structure, c) a plurality of holes formed in said plate, d) each punch having an upper and a lower end, a cutting edge being formed at the upper end of each punch, e) a plurality of n-m wedge elements, f) a plurality of operating bars for adjusting the plurality of wedge elements with respect to said punches, g) means responsive to a predetermined code, for moving selected ones of said operating bars in an axial direction, h) the lower end of each punch contacting a corresponding wedge element, i) said punches being capable of vertical travel between two end positions, j) in one end position, the punches being retained at a level of an upper surface of said plate, while in the other end position, the cutting edge of each punch lies within a corresponding hole in said plate, k) a distance of travel for each punch between its two end positions corresponding to a thickness of each operating bar, l) a counterplate facing said plate, and spaced therefrom to allow the skin to be marked to be placed therebetween, m) means for driving said plate and counterplate downwardly so that the skin is perforated only by those punches which have been elevated to the level of the upper surface of said plate, the punches being elevated in accordance with the predetermined code which controls the selected operating bars and the wedges associated therewith.

2. A machine as claimed in claim 1, wherein the wedges which operate the punches of each row are positioned in a single horizontal plane and are mutually adjacent.

3. A machine as claimed in claim 2, wherein said operating bars are shaped such that at that end which acts on said wedges they lie in a single plane and are mutually adjacent.

4. A machine as claimed in claim 3, wherein at the opposite end to that which acts on said wedges, said bars are provided with articulated joints for their connection to the moving means.

5. A machine as claimed in claim 1, wherein the operating bars for the punches of any row are superposed on the bars of the punches of the other rows.

6. A machine as claimed in claim 1, wherein each punch consists of a cylindrical body provided at its upper end with a cutting part, said counterplate comprising a number of holes equal to the number of said punches and having their axis aligned with the punch axis.

7. A machine as claimed in claim 1, wherein said counterplate comprises collimation elements cooperating with corresponding holes provided in said plate.

8. A machine as claimed in claim 1, wherein said plate comprises holes for housing reference punches, the cutting ends of which are essentially coplanar with the upper surface of said plate when said plate is in its unstressed configuration.

9. A machine as claimed in claim 1, wherein said moving means consist of pneumo-hydraulic cylinders.

10. A machine as claimed in claim 9, wherein said cylinders are provided with conduits opening into a single receiver and are provided with solenoid shut-off valves.

11. A machine as claimed in claim 10, wherein said solenoid valves are controlled by an electronic system.

12. A machine as claimed in claim 1, wherein said counterplate is rigid with piston of a cylinder, the stroke of said piston being controlled by a pedal unit.

13. A machine as claimed in claim 1, wherein said punches consist of cylinders with conical ends and with an internal discharge channel, said counterplate being constructed of soft materials.

* * * * *